US005529037A

United States Patent [19]

Wallis

[11] Patent Number: 5,529,037

[45] Date of Patent: Jun. 25, 1996

[54] LUBRICATION SYSTEM FOR ROTARY VALVE

[75] Inventor: Anthony B. Wallis, Gladesville, Australia

[73] Assignee: A. E. Bishop Research Pty. Limited, North Ryde, Australia

[21] Appl. No.: 424,437

[22] Filed: May 5, 1995

[30] Foreign Application Priority Data

Nov. 6, 1992 [AU] Australia ..... PL5730

[51] Int. Cl.[6] ..... F01L 7/16

[52] U.S. Cl. ..... 123/190.16; 123/190.4; 123/190.6; 123/190.8; 123/190.17

[58] Field of Search ..... 123/190.1, 190.13, 123/190.4, 190.6, 190.8, 190.16, 190.17

[56] References Cited

U.S. PATENT DOCUMENTS

| | | | |
|---|---|---|---|
| 3,892,220 | 7/1975 | Franz | 123/190.16 |
| 4,010,727 | 3/1977 | Cross et al. | 123/190.16 |
| 4,546,743 | 10/1985 | Eickmann | 123/190.16 |
| 4,960,086 | 10/1990 | Rassey | 123/190.16 |
| 5,154,147 | 10/1992 | Muroki | 123/190.17 |
| 5,417,188 | 5/1995 | Schiattino | 123/190.16 |

*Primary Examiner*—Erick R. Solis
*Attorney, Agent, or Firm*—Nikaido, Marmelstein Murray & Oram

[57] ABSTRACT

A rotary valve for an internal combustion engine, of the hollow cylindrical type, characterized in that there are provided in a bore of a cylinder head, in which the valve rotates, oil applicators arranged on either side of openings in the valve, each applicator being loaded by a spring against the surface of the valve at a position such that each applicator bears against the surface of that part of the valve lying between the outer axial extremities of the openings and an adjacent circumferential seal, each applicator allowing flow of oil through it onto the surface of the valve by means of one or more small internal passages.

9 Claims, 4 Drawing Sheets

LUBRICATION SYSTEM FOR ROTARY VALVE

The present invention relates to rotary valves for internal combustion engines and particularly to rotary valves having the following characteristics:

1) A central working portion of the rotary valve rotates in a bore in a cylinder head, in which it is supported so that it always maintains a small radial clearance to the bore. The central working portion contains one or more ports terminating in peripheral openings which, during rotation of the valve, periodically align with a window in the cylinder head. These openings permit the inflow of gas into the cylinder and its exhausting therefrom.

2) The combustion chamber is sealed by "an array of floating seals", this array includes two axial seals to prevent circumferential escape of high pressure gas from the combustion chamber. These axial seals are each housed in a slot in the cylinder head parallel to the longitudinal axis of the valve. One axial seal is located adjacent to each of the axial sides of the window in the cylinder head. The "array" is completed by circumferential seals preventing gas leakage along the surface of the valve in an axial direction.

3) Lubrication and cooling oil are completely sealed from the central working portion by the provision of suitable sealing elements.

In a rotary valve of the kind described above the central working portion located between the circumferential seals is subject to sliding contact with the axial seals. It is therefore necessary to provide lubrication between these surfaces, which poses problems in that it is important to prevent any significant amount of oil passing into the combustion chamber.

The present invention provides a means of lubricating these areas, and enables the amount of oil applied to be regulated in a manner that ensures proper lubrication of the valve while preventing entry of oil into the combustion chamber.

The present invention consists in a rotary valve for an internal combustion engine comprising a hollow cylindrical valve, said valve having one or more ports terminating as openings in its periphery, said valve being supported for rotation in the bore of a cylinder head so that a small radial clearance between the valve and the bore is maintained, said openings periodically passing over a window in said cylinder head bore, said window communicating with a combustion chamber of the engine, sealing means to prevent leakage of gas from the combustion chamber of the engine consisting of axial and circumferential seals, at least one axial seal circumferentially disposed on each side of said window, and at least one circumferential seal axially disposed on either side of said openings, the circumferential seals being spaced a small distance axially outboard of said openings, characterised in that said valve also includes lubricating means consisting of at least two oil applicators in the cylinder head, at least one oil applicator being disposed axially each side of said openings circumferentially between the axial seals and remote from the window, each applicator being loaded against the periphery of the valve at positions such that each applicator bears against the continuous diametral surface of the valve lying between the outer axial extremities of said openings and the adjacent circumferential seal, each applicator allowing flow of oil through it onto the diametral surface of the valve by means of one or more small internal passages, and means to provide said oil applicator with a supply of oil.

It is preferred that each applicator consists of a sintered bronze element that may be surrounded by an impervious wall slideable in a radially disposed bore in the cylinder head, a circumferential 'O' ring on the applicator providing a seal with this bore.

In order that the nature of the invention may be better understood a preferred form thereof is hereinafter described by way of example with reference to the accompanying drawings in which.

Figure 2:
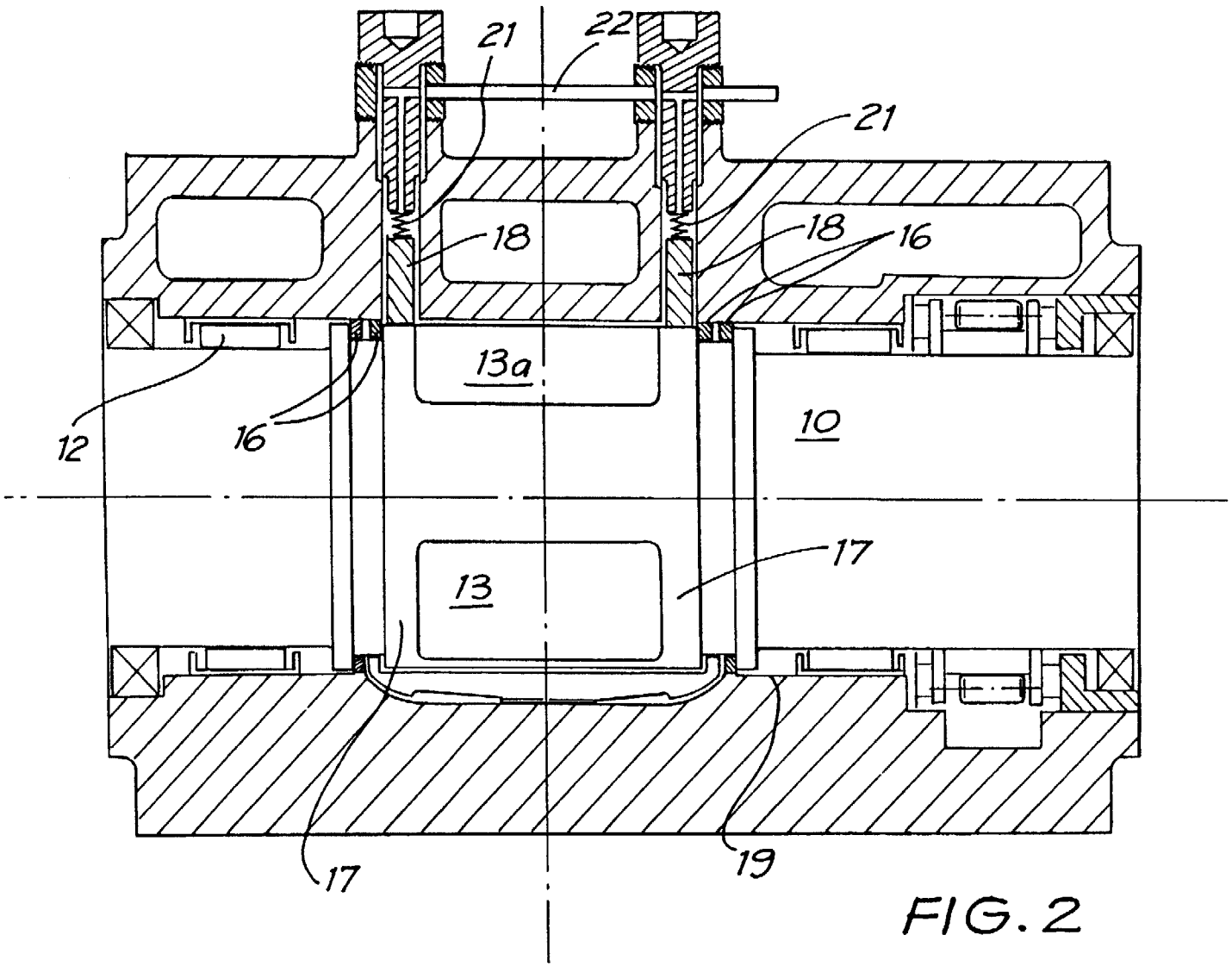
FIG. 2 is a longitudinal section on plane A—A of FIG. 1 (valve not sectioned)

In the construction shown in the drawings rotary valve 10 rotates in a bore 19 in cylinder head 11 in which it is supported by bearings 12 which maintain a small clearance between the peripheral surface of valve 10 and the bore. Peripheral inlet and exhaust port openings 13 and **13*a* in valve 10 rotate past window 14 in the cylinder head 11. The escape of gas from the combustion chamber 33 through window 14 is prevented by axial seals 15 and 15*a* and circumferential seals 16. As is best seen in FIG. 2 there are on either side of the axial extremities of openings 13 and 13*a*, between these and the inner circumferential seals 16, continuous diametral surfaces 17 extending circumferentially around the valve. Against each of these surfaces 17 an oil applicator 18** is spring loaded and it is with the structure and positioning of these oil applicators that the present invention is principally concerned.

Figure 1:
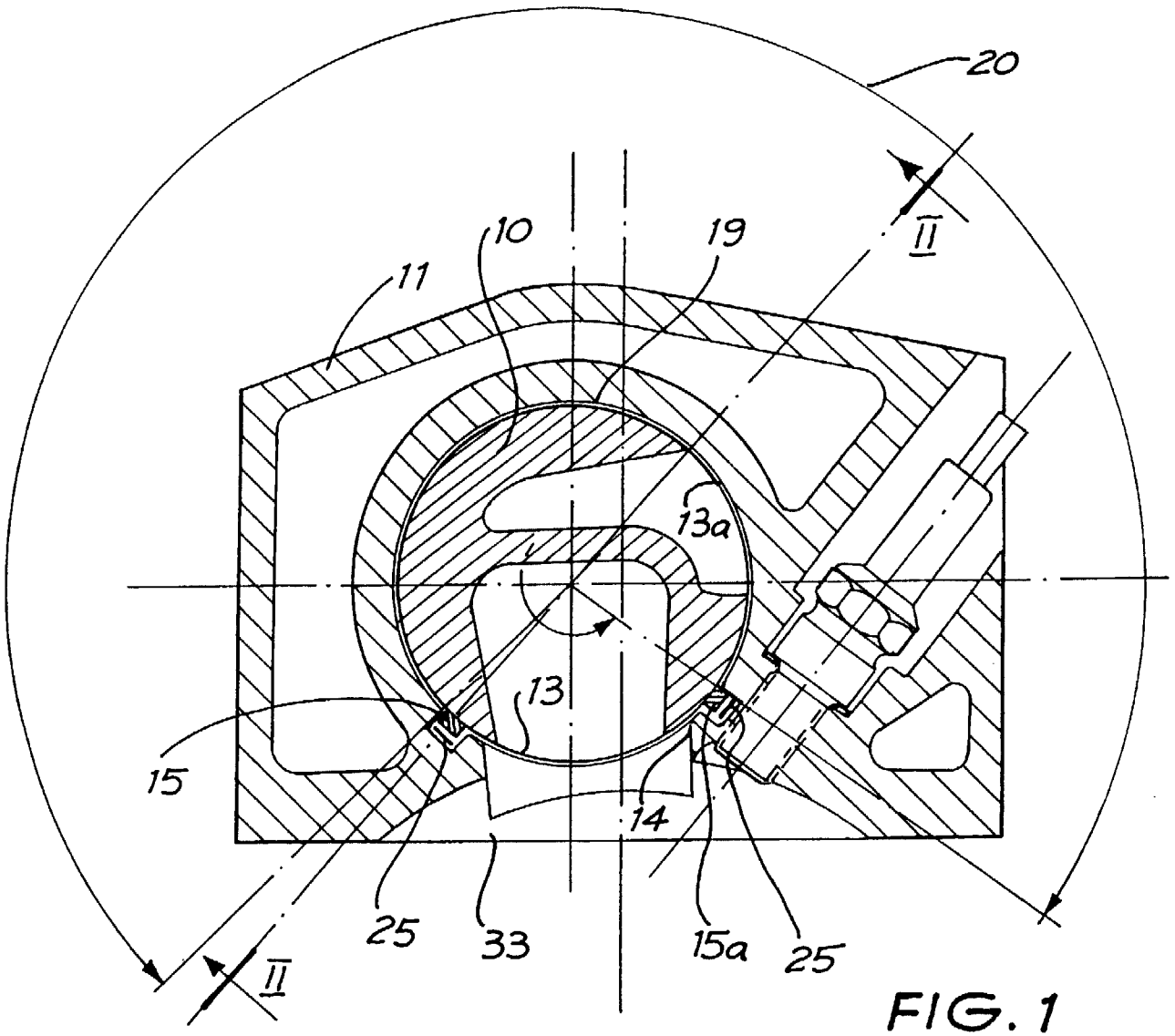
FIG. 1 is a radial cross-sectional view through a rotary valve cylinder head according to the invention.
Figure 3:
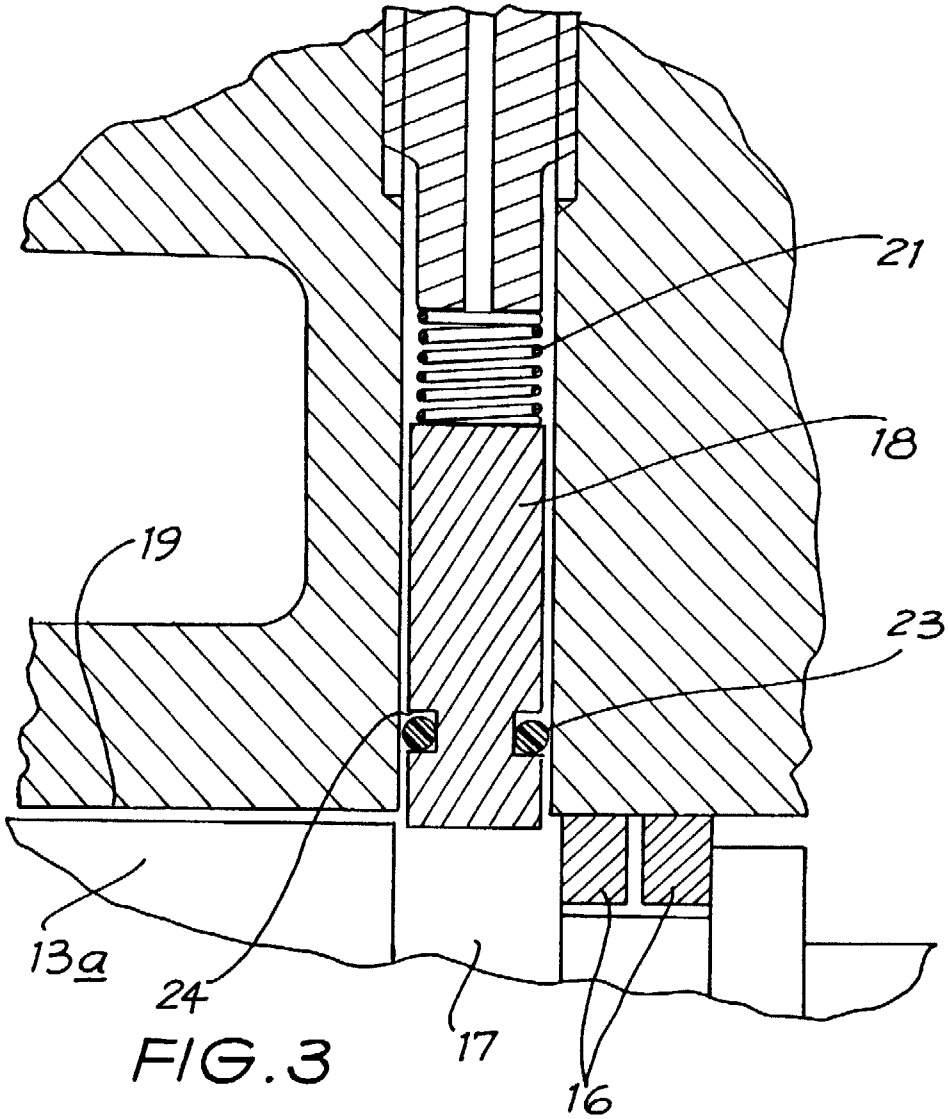
FIG. 3 is a view to an enlarged scale of one of the oil applicators.

The purpose of each applicator 18 is to feed oil directly onto the outer surface of the rotary valve. The quantity of oil fed onto this surface is just sufficient to keep a very thin layer of oil on the valve itself. Applicators 18 have the following characteristics:

a) Each is disposed on the surface of the valve in the zone circumferentially between axial seals 15 and **15*a* and remote from the window 14, ie. in low pressure zone 20 as indicated in FIG. 1. Low pressure zone 20 is the zone in which inlet and exhaust port openings 13 and 13*a*** reside during the compression and power strokes.

b) One applicator 18 is located axially at each end of the central working zone of the rotary valve. They are located inboard of the inner circumferential sealings rings 16 and outboard of the axial extremities of the inlet and exhaust port openings 13 and **13*a*. Each applicator therefore sees an unbroken surface as the valve rotates. This ensures a uniform resistance to the outflow of oil onto the valves surface from the applicator. If the applicator was located inboard of the axial extremities of openings 13 and 13*a*, the applicator would be directly exposed to the air in the openings as they passed beneath the applicator. Each applicator 18 is located in this precise axial location to ensure oil is delivered directly to that surface 17 in which axial seals 15 and 15*a* are most heavily loaded. As exhaust opening 13*a* approaches the leading axial seal 15, the seal has full cylinder pressure behind it pressing it onto valve 10. This is reacted by the full surface of rotary valve 10. As the leading edge of the exhaust opening crosses axial seal 15 this load is now reacted only by the two surfaces 17 of the valve surface axially outboard of the exhaust opening 13***a* itself. In this situation there is a substantial momentary increase in the localised pressure between the seal and the valve. To make matters worse the pressure behind axial seal 15 acts to deflect the centre of the seal into the exhaust opening. This results in line loadings at the circumferential edge of the exhaust opening. It is essential to have oil at these edges if axial seals 15 and 15*a* are to survive.

c) Each applicator itself has a very high resistance to the flow of oil. This is essential as the applicator is located in a zone where it is exposed to the high frequency pressure fluctuations present in the inlet and exhaust ports. These pressure fluctuations generally oscillate around a mean zero pressure. It is essential therefore that the applicator has a sufficient inertia effect to ensure that oil flow cannot respond to high frequency pressure variations but only to the low frequency variation of mean pressures.

d) Each applicator 18 is spring, loaded by spring 21 against the outer diameter of rotary valve 10 to ensure it is always in intimate contact with the surface of the valve.

e) Oil is fed onto each applicator 18 from oil line 22. The pressure of the oil delivery being varied according to the load and speed of the engine. In its simplest form the pressure delivery is predetermined as a function of throttle setting and engine speed. In more sophisticated arrangements a feed-back control system can be used to vary the pressure and hence the rate of oil delivery. In the event that it is established that some operating conditions produce a mean back pressure in the low pressure zone 20, it may be necessary to monitor the delivery as a function of the differential pressure between the supply pressure and the mean pressure in the low pressure zone 20. Alternatively oil may be supplied to the applicator via a positive displacement pump whose output varies as some function of engine speed and load.

f) Each applicator is arranged to have a very small clearance in its housing in the cylinder head. This is to minimise the volume of oil that can accumulate around the applicator under some operating conditions only to be sucked out quickly under other operating conditions.

g) The outer diameter of each applicator 18 incorporates 'O' ring 23 fitted into a circumferential groove 24 (see FIG. 3) located as close to the rotary valve surface as possible (to minimise the problem referred to in f). This 'O' ring 23 seals the outer surface of applicator 18 and turns the applicator into a hydraulic piston—ie. the oil pressure pushes the applicator onto the surface of the valve with a force that is proportional to the supply pressure.

h) In the preferred embodiment, applicator 18 consists of a cylinder of sintered bronze with a groove 24 at one end. The outer surface and the groove 24 of this sintered bronze element may be coated with a material to seal these surfaces against the outflow of oil. The ends of the cylinder are left uncoated to allow the passage of oil from one end to the other.

The resistance to the passage of oil in these sintered bronze components can be varied by varying the degree of compaction of the tiny bronze particles from which they are made prior to sintering, by varying the size of the bronze particles used, and by varying the length of the applicator. By varying these parameters it is possible to achieve an almost limitless range of flow resistance.

The sintered bronze components have the advantage of providing numerous tiny passages through which the oil can pass. They can therefore tolerate a small quantity of dirt which would block the oil supply to an applicator which consisted of a single feed hole of the requisite size.

The nature of the sintered bronze means there are very large surface tension and capillary effects. Even in the absence of oil pressure, oil will always migrate down the applicator to the rotary valve surface. The same surface tension effect will prevent oil draining out of the applicator over the surface of the rotary valve in the absence of oil pressure to actively push the oil out of the applicator end.

Applicators 18 deliver minute quantities of oil onto the surface of the rotary valve at each end of the central working zone. The quantity of oil is just sufficient to wet the surface of the valve ie. it is not supplied in sufficient quantity for the oil to be subjected to effects resulting from the motion of the valve—for example the oil is not thrown outward onto the housing wall as a result of centrifugal effects. The layer of oil is sufficiently thin to ensure that the surface tension effect dominates.

As mentioned above, applicators 18 are so positioned as to ensure that oil is delivered to the surface of the valve in the most highly loaded location. It is however essential to have lubrication over the entire surface of the axial seal during the compression and combustion strokes. It is therefore necessary to have a mechanism which allows the localised application of oil to be dispersed axially along the entire valve surface.

The mechanism for the disbursement of this oil involves the interaction of the oil on the valve's surface and the leading axial seal 15. There are several mechanisms operating. The mechanism that dominates depends on the details of the axial seals and the quantity of oil deposited onto the surface of valve 10.

The simplest mechanism is that of the axial seal 15 acting as a scraper. This is particularly dominant if the leading edge of the axial seal (whose mating surface conforms with that of the valve) is not relieved ie. is sharp edged and acts as an oil scraper. This mechanism is also favoured if the quantities of oil delivered are high.

During the induction and exhaust strokes the axial seals are not subject to significant gas loads. Axial seals 15 and 15*a* are preloaded against the valves by means of leaf springs 25.

Figure 4:
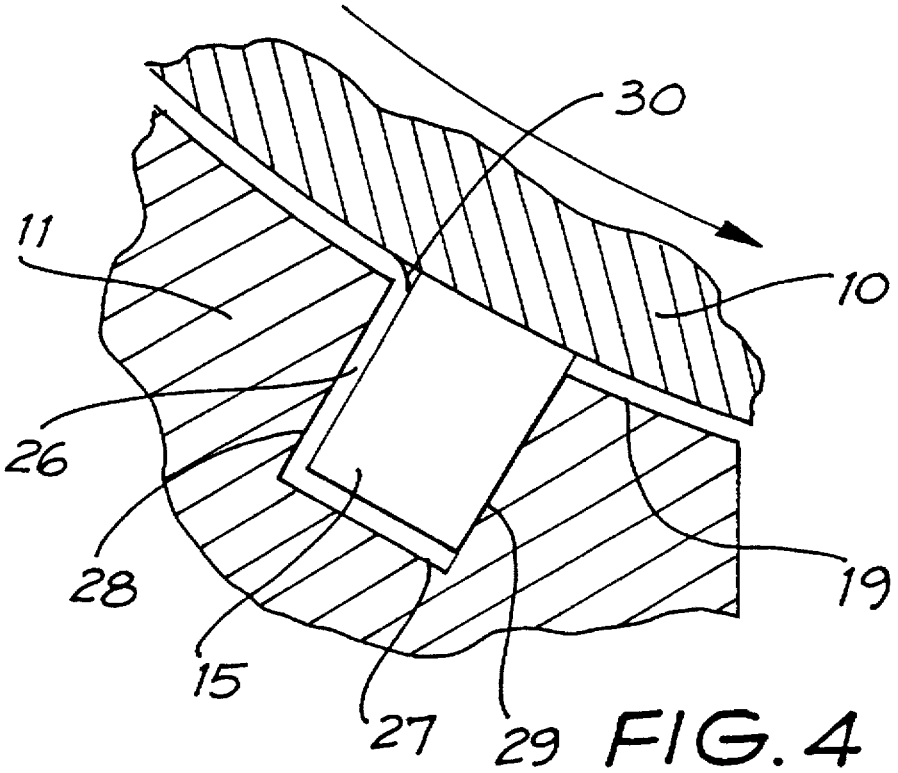
FIG. 4 shows diagrammatically the oil distributing action of the leading axial seals.

The rotation of the valve drives the leading axial seal 15 towards inner face 29 of axial seal slot 27. Excess oil on the surface of the valve is scraped off by the axial seals. This oil 30 accumulates in the cavity 26 (see FIG. 4) behind the axial seal 15 ie. the cavity formed by the clearance of the axial seal in slot 27. Surface tension and capillary effects distribute this oil along the length of this cavity.

Figure 5:
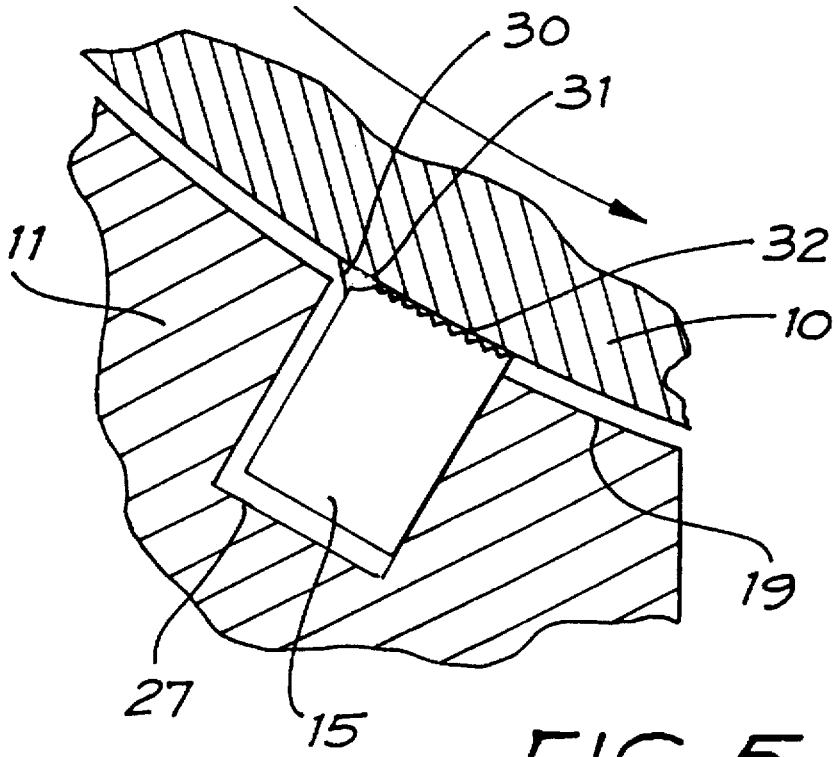
FIG. 5 shows diagrammatically another embodiment of the leading axial seal.

Once the compression stroke commences, the axial seal is pushed back onto sealing face 28. This movement pushes the oil upward into contact with the valve surface—wetting the surface of the valve at the critical moment ie. as the seal becomes pressed onto the surface of valve by combustion pressure.

Where the supply of oil is more limited other mechanisms dominate. In a preferred embodiment of the invention shown in FIG. 5 the axial seals are characterised by the following features:

a) The leading edge of axial seal 15 is relieved so that oil on the valve is rotated into a converging cavity 31. This creates conditions suitable for the occurrence of hydrodynamic lubrication similar to that experienced by piston rings.

b) The surface of the axial seal that seats against the rotary valve is characterised by a series of very small interconnected hollows 32 below its surface. These hollows allow oil to accumulate below and close to the surface of the axial seals. Oil is able to migrate below the surface of the seals. A suitable surface may be formed by electro discharge machining the cylindrical contour into the surface of a cast iron axial seal. This feature is too small to illustrate in the drawings at full scale so is exaggerated for the purposes of explanation. In this arrangement oil driven into the converging cavity 31 is able to migrate axially along this cavity from where it is driven across the face of the axial seal 15 or 15*a* through the interconnected hollows 32. During the compression/combustion process high pressure air tries to penetrate between the surfaces of the axial seal and valve 10. The presence of oil in the subsurface of the axial seals 15 and 15*a* prevents the passage of this air between the surfaces. The high pressure air does however push the oil at the trailing edge towards the leading edge—in the process this oil banks up and emerges above the surface of axial seal 15 or 15*a* wetting the surface of the valve.

It will be appreciated by persons skilled in the art that numerous variations and/or modifications may be made to the invention as shown in the specific embodiments without departing from the spirit or scope of the invention as broadly claimed. The present embodiments are, therefore, to be considered in all respects as illustrative and not restrictive.

I claim:

1. A rotary valve for an internal combustion engine comprising a hollow cylindrical valve, said valve having one or more ports terminating as openings in its periphery, said valve being supported for rotation in the bore of a cylinder head so that a small radial clearance between the valve and the bore is maintained, said openings periodically passing over a window in said cylinder head bore, said window communicating with a combustion chamber of the engine, sealing means to prevent leakage of gas from the combustion chamber of the engine consisting of axial and circumferential seals, at least one axial seal circumferentially disposed on each side of said window, and at least one circumferential seal axially disposed on either side of said openings, the circumferential seals being spaced a small distance axially outboard of said openings, characterised in that said valve also includes lubricating means consisting of at least two oil applicators in the cylinder head, at least one oil applicator being disposed axially of each side of said openings and circumferentially between the axial seals and remote from the window, each applicator being loaded against the periphery of the valve at positions such that each applicator bears against the continuous diametral surface of the valve lying between the outer axial extremities of said openings and the adjacent circumferential seal, each applicator allowing flow of oil through it onto the diametral surface of the valve by means of one or more small internal passages, and means to provide said oil applicator with a supply of oil.

2. A rotary valve as claimed in claim 1 wherein each oil applicator consists of a cylinder of material slideable in a substantially radially disposed bore, at least one annular seal contained in a circumferential groove in the periphery of said applicator providing a seal with the bore.

3. A rotary valve as claimed in claim 1 wherein each oil applicator consists of a cylinder of material slideable in a substantially radially disposed bore, at least one annular seal contained in an internal circumferential groove in the bore providing a seal with the periphery of said applicator.

4. A rotary valve as claimed in claim 2 wherein each applicator consists of a sintered metal element in which small particles of material are compacted together and then sintered to form a multitude of small internal passages.

5. A rotary valve as claimed in claim 4 wherein the material of which the applicator is made is sintered bronze.

6. A rotary valve as claimed in claim 1 wherein each axial seal has a surface contoured to conform generally to the periphery of the valve.

7. A rotary valve as claimed in claim 6 wherein the contoured surface of each axial seal consists of a series of small interconnected hollows.

8. A rotary valve as claimed in claim 6 wherein the contoured surface at the leading edge of at least one axial seal is relieved in the form of a shallow chamfer to form a converging cavity between the periphery of said valve and said chamfer.

9. A rotary valve as claimed in claim 1 wherein the circumferential seals are of the piston ring type housed in circumferentially extending grooves in the periphery of the valve and preloaded against the cylinder head bore.

* * * * *

UNITED STATES PATENT AND TRADEMARK OFFICE

CERTIFICATE OF CORRECTION

PATENT NO. : 5,529,037
DATED : June 25, 1996
INVENTOR(S) : Wallis

It is certified that error appears in the above-indentified patent and that said Letters Patent is hereby corrected as shown below:

On the title page: Item [22] PCT filed : Nov. 3, 1993 [86] PCT No: PCT/AU93/00570 371 Date: May 5, 1995 102(e) Date: MAY 5, 1995 [87] PCT Pub. No.: WO94/11620 PCT Pub. Date: May 26, 1994 —.

Signed and Sealed this

Tenth Day of December, 1996

*Attest:*

*Attesting Officer*

BRUCE LEHMAN

*Commissioner of Patents and Trademarks*